US005799467A

United States Patent [19]

Nankervis et al.

[11] Patent Number: 5,799,467

[45] Date of Patent: Sep. 1, 1998

[54] BREATHABLE GIRTH UNIT FOR A TUBE FORMER IN A PACKAGING APPARATUS AND METHOD

[75] Inventors: Wayne T. Nankervis, Hortonville; Gary L. Dufek, Green Bay; David S. Pantel, Sheboygan, all of Wis.

[73] Assignee: Paper Converting Machine Company, Green Bay, Wis.

[21] Appl. No.: 859,811

[22] Filed: May 19, 1997

[51] Int. Cl.[6] ..... B65B 9/06

[52] U.S. Cl. ..... 53/450; 53/550; 53/551; 53/567; 53/261

[58] Field of Search ..... 53/550, 551, 552, 53/553, 554, 567, 568, 530, 257, 261, 262, 504, 439, 450

[56] References Cited

U.S. PATENT DOCUMENTS

| | | | |
|---|---|---|---|
| 1,710,979 | 4/1929 | Herbener | 53/530 |
| 3,036,415 | 5/1962 | Ayres | 53/262 |
| 3,415,171 | 12/1968 | Wilson | 53/551 |
| 4,671,047 | 6/1987 | Mugnai | 53/550 |
| 4,679,379 | 7/1987 | Cassoli | 53/550 |
| 4,939,889 | 7/1990 | Watanabe | 53/550 |
| 5,165,221 | 11/1992 | Udelson | 53/550 |
| 5,255,495 | 10/1993 | Kovacs | 53/504 |
| 5,408,806 | 4/1995 | Lin | 53/550 |
| 5,433,063 | 7/1995 | Kovacs | 53/550 |

*Primary Examiner*—John Sipos
*Assistant Examiner*—James P. Calve

[57] ABSTRACT

A breathable girth former for a packaging machine for bathroom tissue and kitchen toweling rolls wherein the entrance funnel (preformer) has two halves resiliently mounted to conform to the product dimension most likely to jam in the downstream girth former. The funnel halves movement is transmitted to the girth tube former halves by a mechanical linkage to provide the same spacing as in the funnel.

19 Claims, 9 Drawing Sheets

BREATHABLE GIRTH UNIT FOR A TUBE FORMER IN A PACKAGING APPARATUS AND METHOD

This invention relates to machines for packaging rolls or groups of rolls in a film, and in particular to a breathable girth control for a tube former in such machines and method of operation thereof. Co-owned U.S. Pat. No. 5,255,495 teaches the present art in detail.

BACKGROUND OF INVENTION

Prior to the instant invention, funnels and girth former combinations were made for a specific product diameter. The previous girth former design was fixed and had no adjustment. Although the funnels could be adjusted independently, they were not connected to the girth former. The fixed design could accommodate variation in product outside diameters generally ranging from 2 mm to 6 mm. These variations in diameter come from wound roll tension, paper caliper and paper density. With product outside diameters below the lower limit, the package overwrap tended to become unacceptably loose. With product outside diameters above the higher limit, product jams resulted at the girth former.

Several improvements to this design have been made over the last several years such as manual screw adjustable girth formers—as in the '495 patent. These, however, do not adjust to product outside diameter variation automatically, and cannot possibly be done from one product to the next in an automatic operation.

The instant invention which we term the "breathable girth former" differs in design through its ability to automatically sense and adjust to product outside diameter variation as previously described. Benefits to this concept include providing a girth former that is designed to overwrap a greater range of product outside diameter variation, thereby potentially reducing equipment capital cost to customers as well as potentially reducing process waste and delay experienced from earlier girth former designs.

SUMMARY OF INVENTION

A breathable girth unit for a tube former in a packaging apparatus in which products comprising individual rolls or groups of rolls are conveyed continuously one after another and are packaged in film, the tube former being situated to continuously form a sheet of film passing through the tube former into a tube encapsulating and transferring succeeding product, the breathable girth unit includes frame means defining a longitudinally-extending, linear path of travel for the products, a two piece funnel mounted on the frame means with a funnel-providing piece on each side of the path resiliently coupled to the frame means whereby entrance of an oversized product into the funnel causes the funnel-providing pieces to move laterally outward from the linear path, the tube former also including two pieces flanking the linear path means mounting the tube former pieces on the frame means for movement laterally toward and away from the linear path, and a connecting arm means coupling the respective pieces of the funnel with the pieces of the tube former for cojoint movement of the tube former pieces to the funnel pieces upon entrance of the oversized product into the funnel.

In the illustrated embodiment, the breathable portion of the girth former includes two movable half sections that spread apart laterally in opposite directions as product passes through the girth former. The lower portion of the girth former, although fixed, has limited adjustment to aid in film tracking. Just upstream of the breathable girth former, product is pushed through funnels by a conventional overhead conveyor with product pusher paddles attached. Below the overhead conveyor, funnel pieces are mounted longitudinally on either side of the product centerline. These help direct the product as it enters the breathable girth former. The product is supported from beneath by a dead plate. In this application, product is oriented with the core down, i.e., with its axis extending longitudinally of the path, and flows longitudinally through the funnels and breathable girth former.

The "breathable" function is provided automatically by spring loading each funnel independently on rods guided through linear bearings. The opening of the funnels that the product is pushed through is pre-set to a diameter that is approximately one sixteenth of an inch smaller than the smallest product diameter. The circumferential surface of the product entering the funnels is, therefore, always in contact with the inside circumferential surface of each funnel. Product moving through the funnels forces them to move apart horizontally in opposite directions against the constant pressure provided by the springs. Individual connecting arms from each funnel are fastened to each of the movable half girth former sections thereby creating a direct link of motion from each funnel to each of the girth former sections. Each girth former section also has two guide rods mounted in linear bearings that move in opposite directions horizontally in conjunction with movement received through its receptive connecting arm and funnel.

In this application the girth former half sections overlap at the bottom and are supported by a backing plate. One half of the girth former sections also slides on the top surface of the backing plate. Film for overwrapping the product passes through an opening between the leading edge of the girth former half sections, the funnels and dead plate in the same manner it does in the current process. Film travels over and is supported by the fixed lower section and the movable upper girth former half sections again much in the same fashion as on the existing process.

A significant advantage of the invention is to avoid the engagement of an oversized product with the entering end of the tube former. When this occurred in the prior art constructions, the entire production line had to be shut down to remove the product and film and rethread the film. This is now all avoided by having an instantaneous connection to the tube former upon the appearance of an oversized product. Thus, for the first time, there is a positioning of the tube former halves "on the fly", i.e., when the machine is in motion and fully operational. In fact, the invention provides the ultimate safeguard by adjusting the tube former halves for each product as it enter the funnel.

DETAILED DESCRIPTION

The Prior Art

Figure 1:
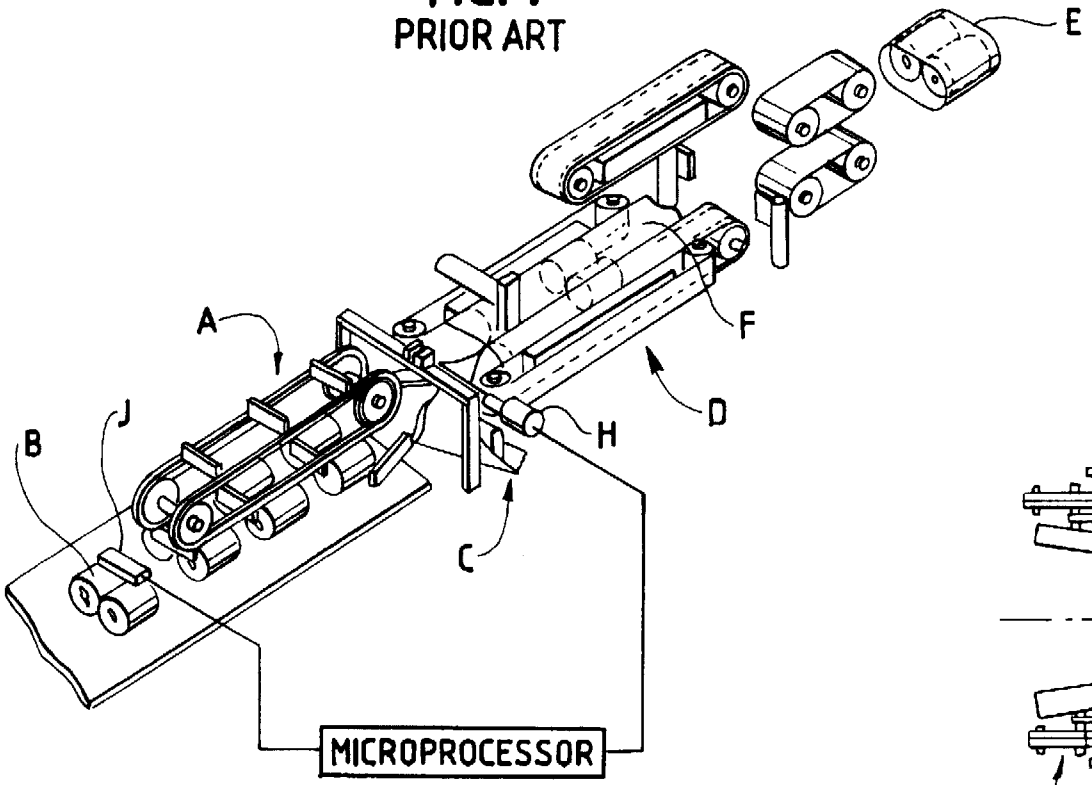
FIG. 1 PRIOR ART
FIG. 1 is a perspective schematic view of the prior art adjustable girth former seen in FIG. 1 of co-owned U.S. Pat. No. 5,255,495.

As mentioned above, the prior art is exemplified by co-owned U.S. Pat. No. 5,255,495. FIG. 1 thereof which is reproduced here also as FIG. 1.

A girth forming apparatus and the surrounding operative elements of a packaging machine according to the prior art is depicted generally in FIG. 1. The depicted portions of the packaging apparatus include an overhead conveyor section A for conveying rolls B in alignment and regularly into an adjustable girth forming apparatus C, in which the rolls are encapsulated in a plastic film F. The film and rolls exit the girth forming apparatus C in a pull belt section D. Successive rolls or groups of rolls are then severed while encapsulated in a tubular section of the plastic film to form a partially sealed package E. Downstream processing includes sealing the ends of the package to complete the packaging process in a conventional fashion.

The overhead conveying section A may be conventional, comprising a series of paddles endlessly revolved about sprockets. The paddles align and convey the rolls B across a deadplate into the adjustable girth forming apparatus C.

At the exit end of the conveying section and at the entrance to the girth forming apparatus, an adjustable preformer G (see FIG. 2) accepts the rolls B, and compresses the rolls sufficiently to permit easy entry into the girth forming apparatus. The preformer and girth forming apparatus are mutually adjustable.

Figure 2:
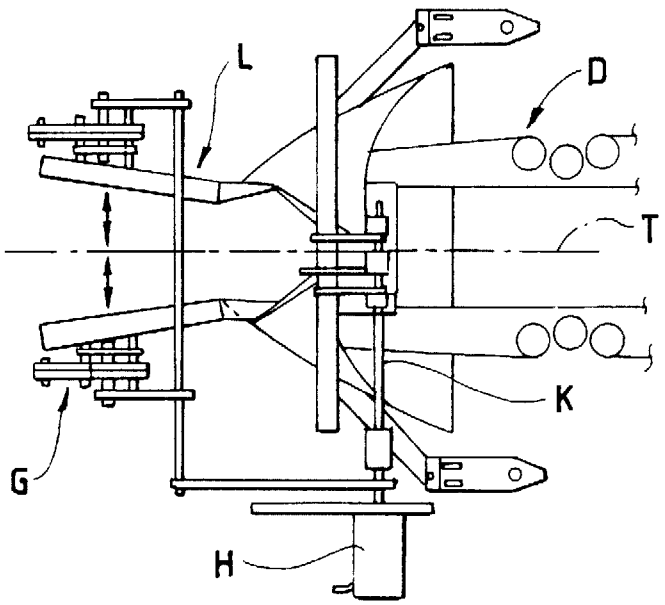
FIG. 2 PRIOR ART
FIG. 2 is a plan view of the prior art adjustable girth former of the '495 patent.

Referring now to FIG. 2, a rotary actuator H is combined with the MICROPROCESSOR and sensor J to sense the dimensions of rolls B, average the same and rotate oppositely threaded rod K to adjust the sections of former C as well as the spacing of the members making up the preformer G via rod and linkage L.

The Invention

The invention is first described in connection with FIG. 3 where certain conventional, prior art components have been omitted for clarity of presentation and ease of understanding. For example, the overhead conveyor A at the upstream or entering end is omitted. We start with what the prior art called the "preformer" but which we call a funnel generally designated 20 made up of two pieces or halves 20*a*, 20*b*. The funnel halves are movably supported on supports 21*a*, 21*b* carried by the machine frame generally designated 21—see the left hand portion of FIG. 4.

Each funnel half is secured to a mounting block as at 22—here we describe the mounting of only one of the funnel halves to avoid complicating the drawings. It will be understood that the un-numbered side has the same components. Between the mounting block 22 and the support 21*b* for example, we provide spring carrying rods 23—see especially the left lower portion of FIG. 5. The rods 23 extend into bearing blocks 24. The double connection via the spring loaded rods 23 is done to make sure that the funnel halves or pieces 20*a*, 20*b* move perpendicularly, i.e., normal to the linear path of travel T of the product P—again see FIG. 5.

Figure 9:
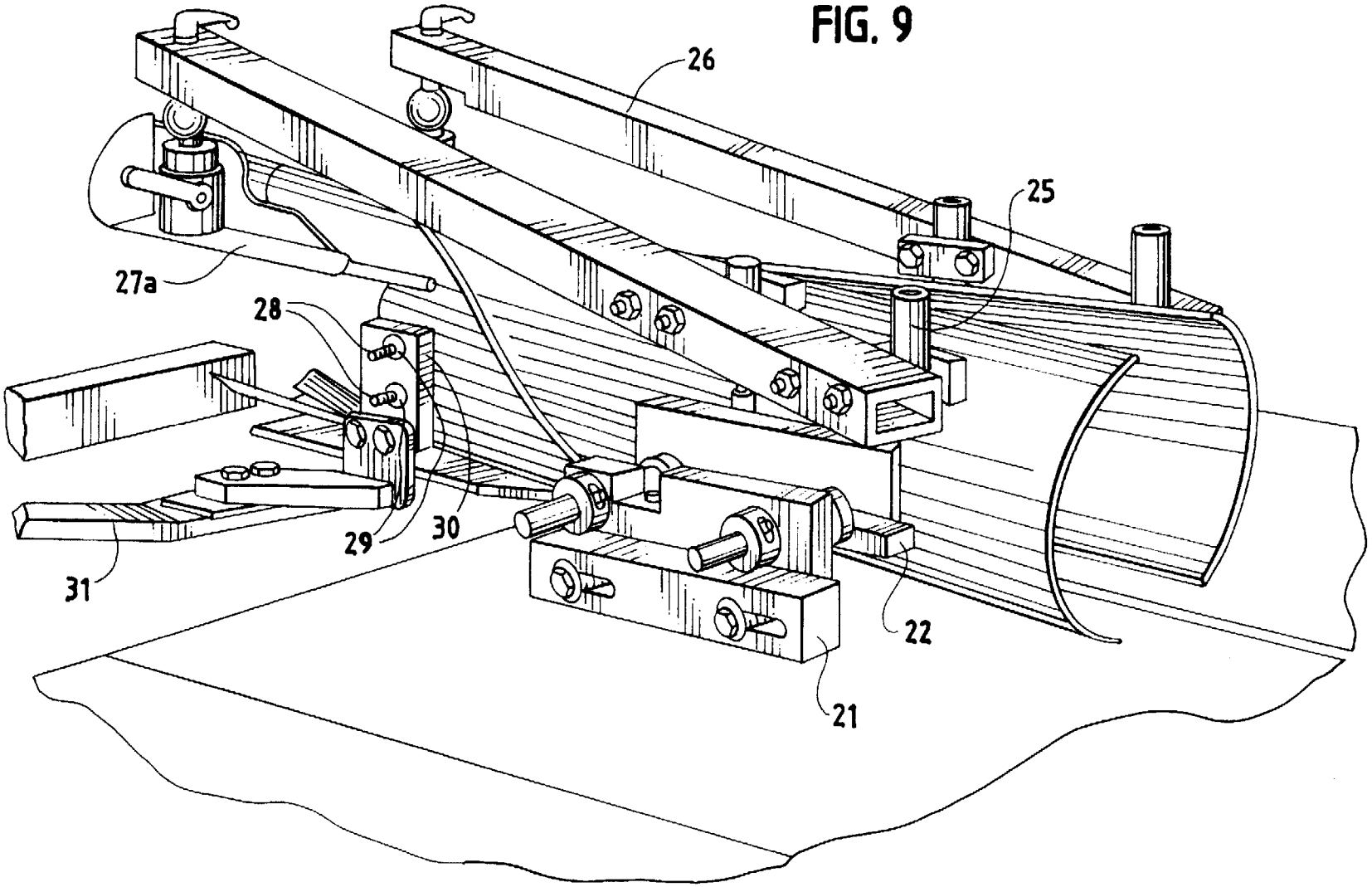
FIG. 9 is a fragmentary perspective view looking at the end of the funnel from the left side thereof as along the sight line 9—9 applid to FIG. 5.

This movement is then transmitted via vertical posts 25 to arms 26 which, in turn are connected to the halves 27*a*, 27*b* of the girth former generally designated 27—a slightly different perspective view being depicted in FIG. 9. This insures that the movement of the funnel halves 20*a*, 20*b* will be transmitted to the girth former halves 27*a*, 27*b* so that there will be a positioning of these girth former halves prior to the time the product P enters the girth former—thereby avoiding any product "hang-up" on the girth former. The girth former is generally designated 27 having two upper halves or pieces 27*a*, 27*b* and a fixed but adjustable lower portion 27*c*—see FIG. 7.

Figure 6:
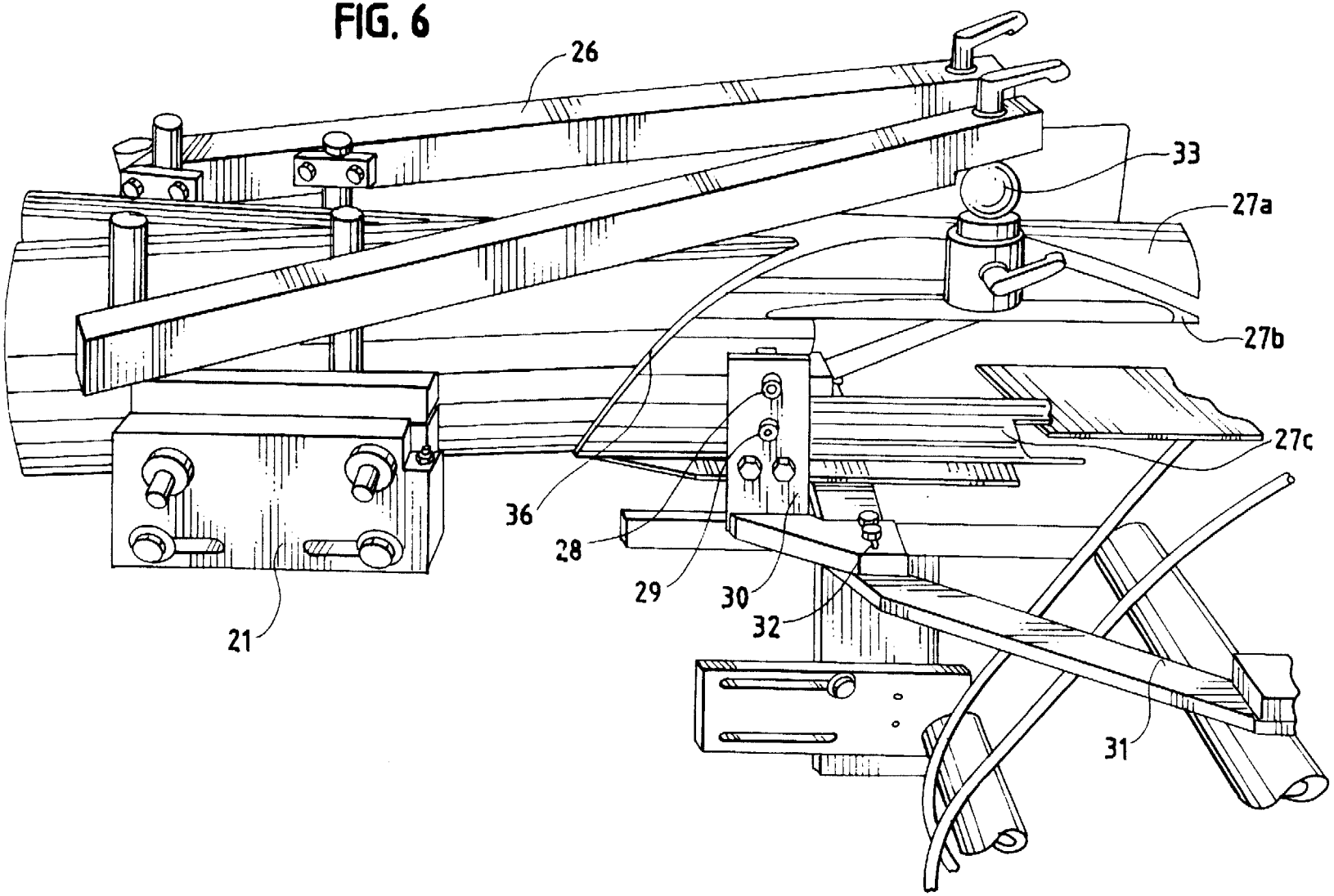
FIG. 6 is a fragmentary side perspective view such as would be seen along the sight line 6—6 of FIG. 5.

To insure that the girth former halves or pieces 27*a*, 27*b* also move perpendicularly to the path of travel T, we provide a pair of vertically spaced rods 28—see the lower left in FIG. 9. These rods are fixed to the tube former halves 27*a*, 27*b* and extend into a pair of bushings 29 provided in bracket 30—here disposed with their lengths aligned, vertically spaced and their lengths extending perpendicularly to the path of travel T of the product P. Thus, both the funnel halves and the girth former halves have spaced apart mountings on the frame—the brackets 30 being fixed to adjustment arms 31 which have a number of adjustable features as at the bolt and slots 32—see FIG. 6.

Figure 8:
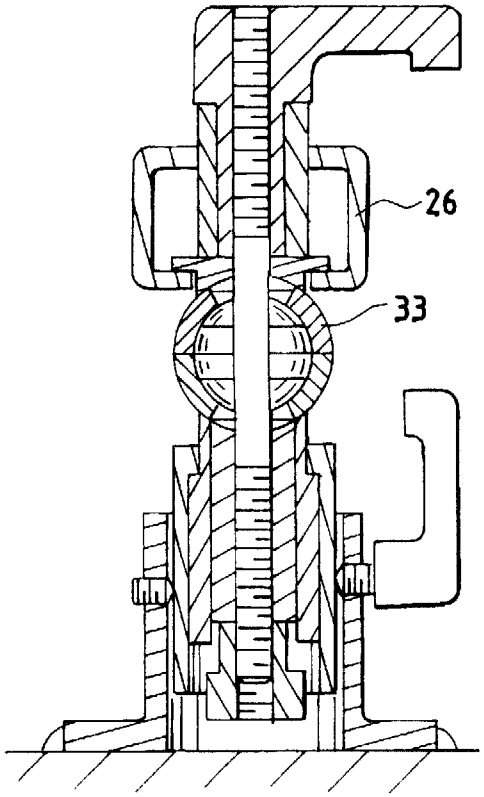
FIG. 8 is a fragmentary sectional view of a universal joint used in the connection of the actuating arms to each half of the tube former.
Figure 7:
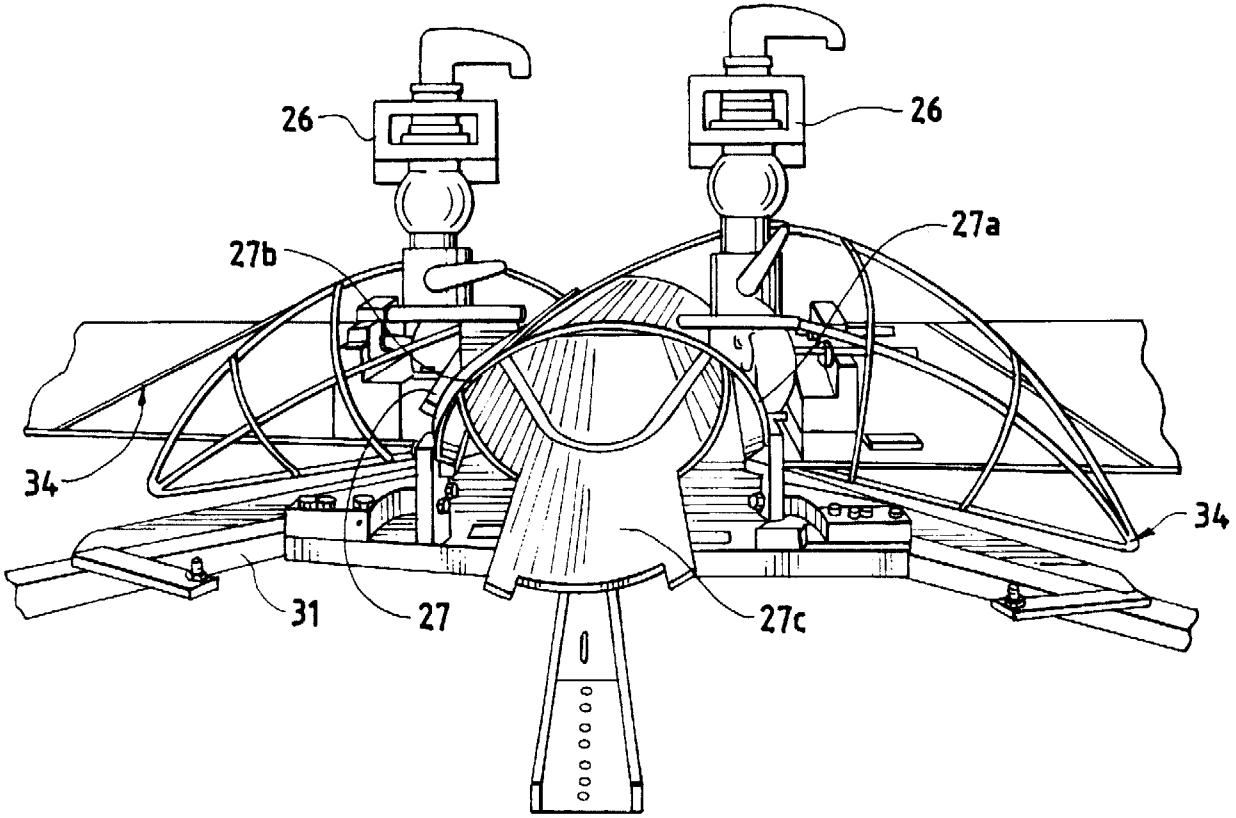
FIG. 7 is a modified sectional view such as would be seen along the sight line 7—7 of FIG. 5.

Now referring to FIGS. 7 and 8, it will be noted that the connection between each arm 26 and its associated girth former piece 27 includes a ball and spherical washer joint 33. This prevents the arm-piece connection from binding. Details of a preferred joint are seen in FIG. 8.

Also seen in FIG. 7 is a lattice-like framework generally designated 34. This provides a guide means for the film F designated by the arrow F in FIG. 4. This differs from the prior art where a solid plate or guide was used. Here we have a solid skirt 35 adjacent the film source (not shown). This skirt 35 supports the open lattice work or mesh or cage 34 for the final travel of the film F. By having substantial open spaces in the film guide, there is access to the film and the connections to the girth former halves 27*a*, 27*b* should repair be necessary.

These former halves or pieces 27*a*, 27*b* are spaced apart by a curved spacing or slot 36 which permits the film to overlap itself for the longitudinal seal conventionally provided in the tubular wrapping. Not pictured are the means for developing conventional cross seals for closing the ends of the packages E.

Figure 3:
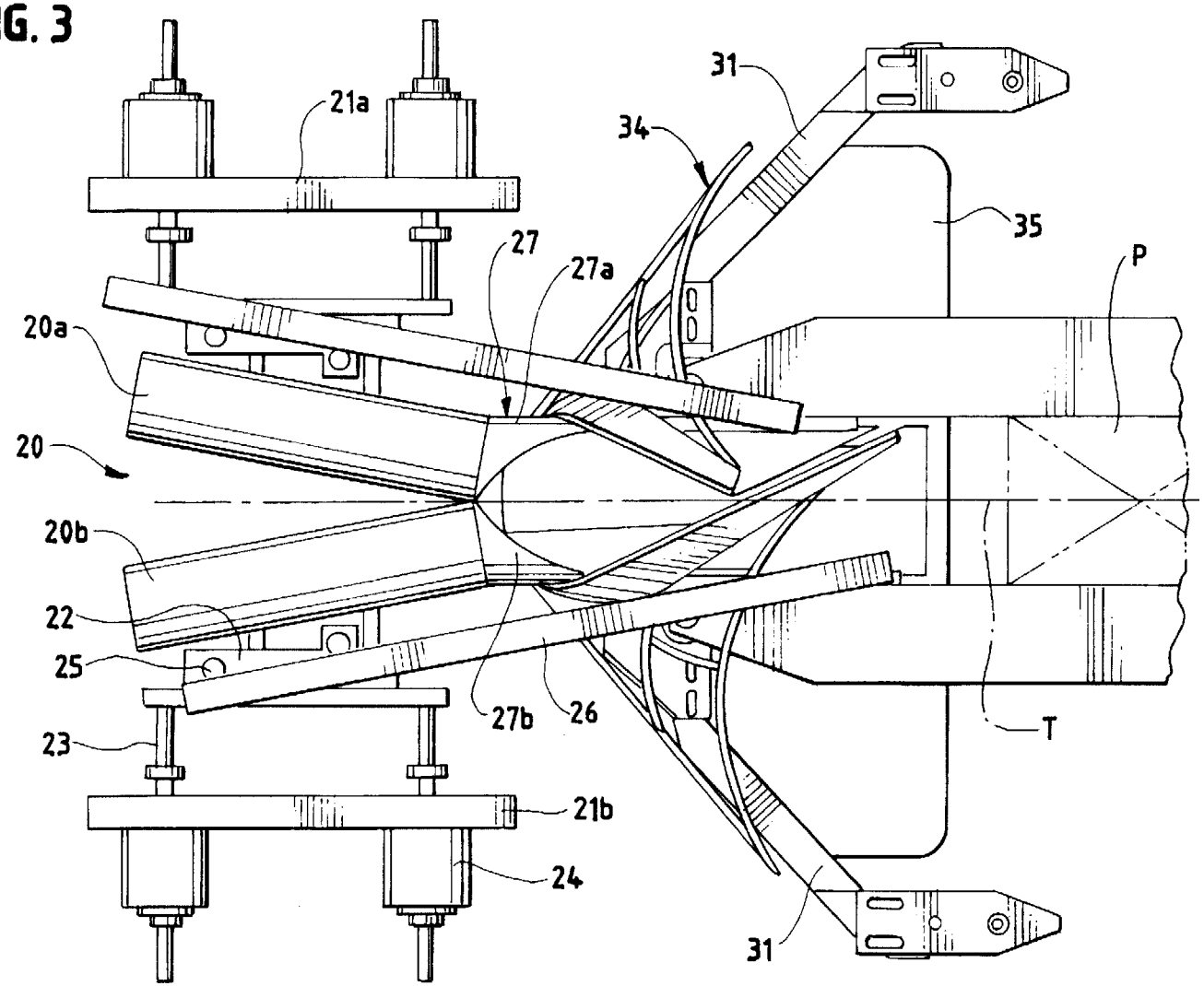
FIG. 3 is a plan view essentially schematic of the breathable girth former of the instant invention.
Figure 4:
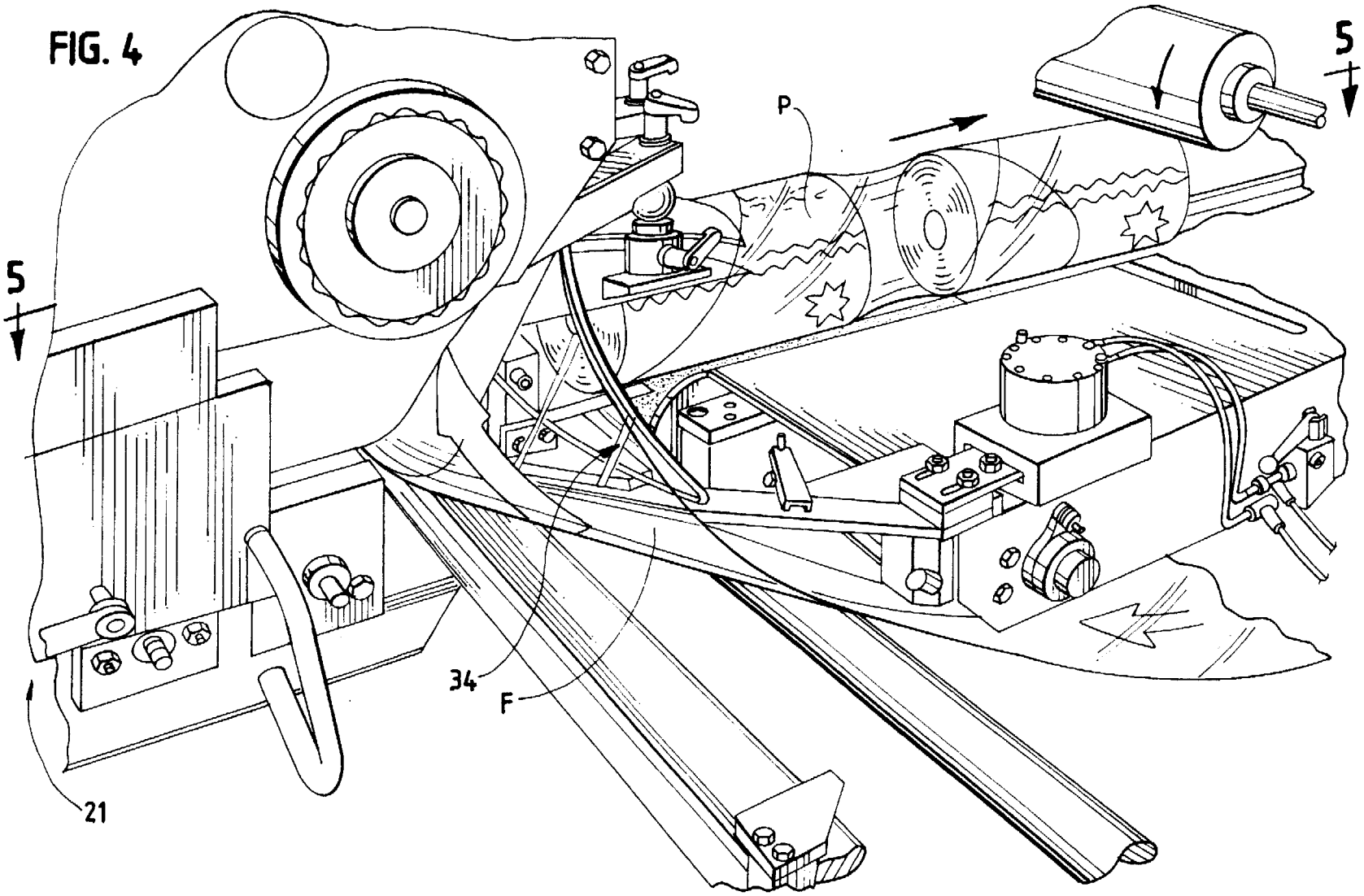
FIG. 4 is a fragmentary perspective view of the tube former portion of this invention.
Figure 5:
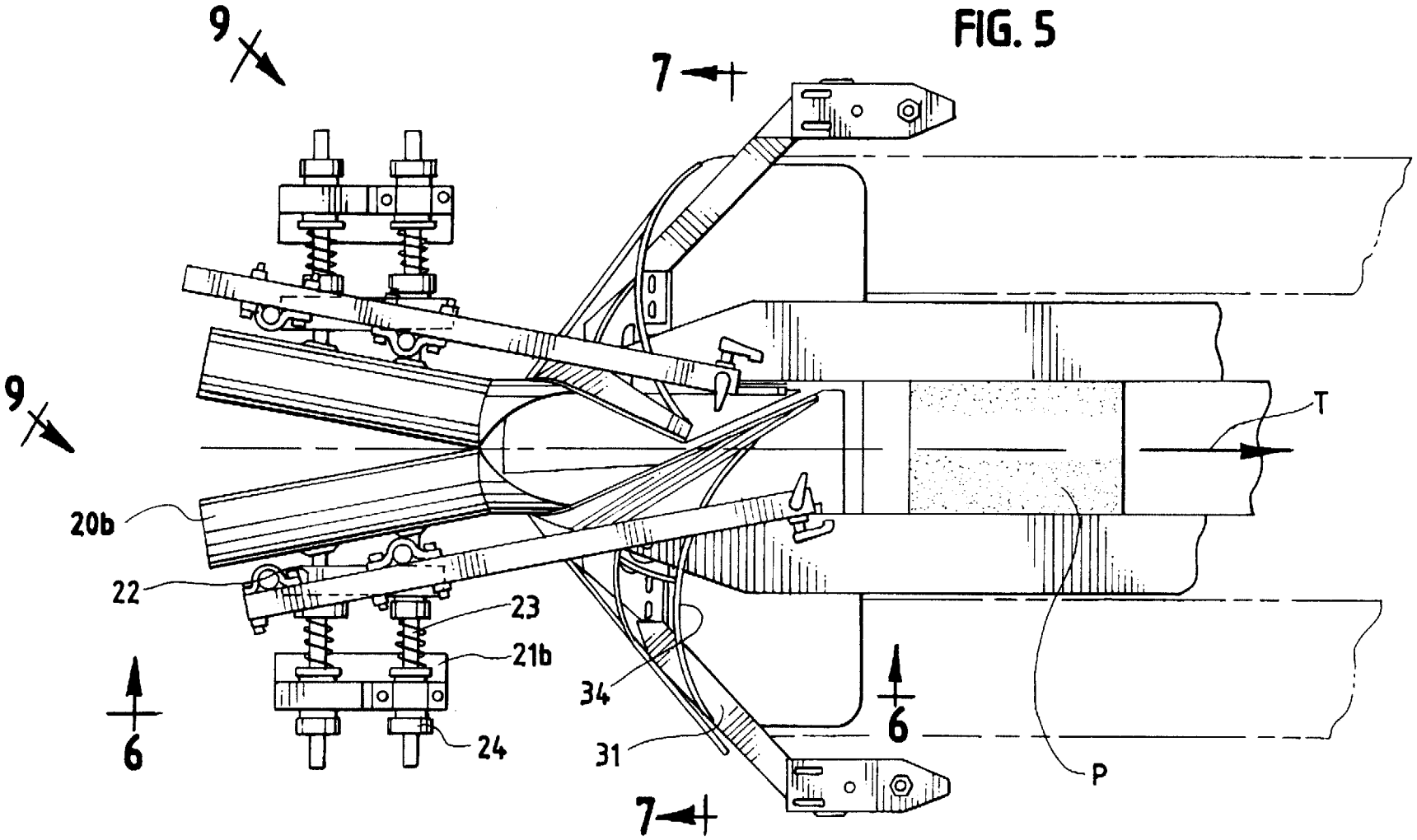
FIG. 5 is a fragmentary plan view of the breathable girth former of the instant invention and featuring more detail than FIG. 3.
Figure 11:
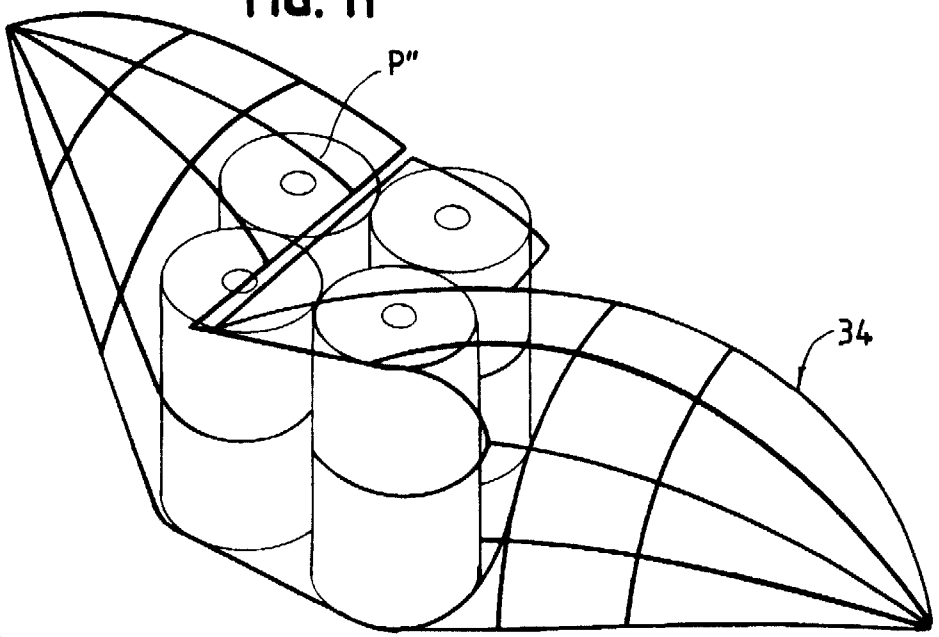
FIG. 11 is a view similar to FIG. 10 but showing two levels of more than one product wide, cores again being "up"
Figure 10:
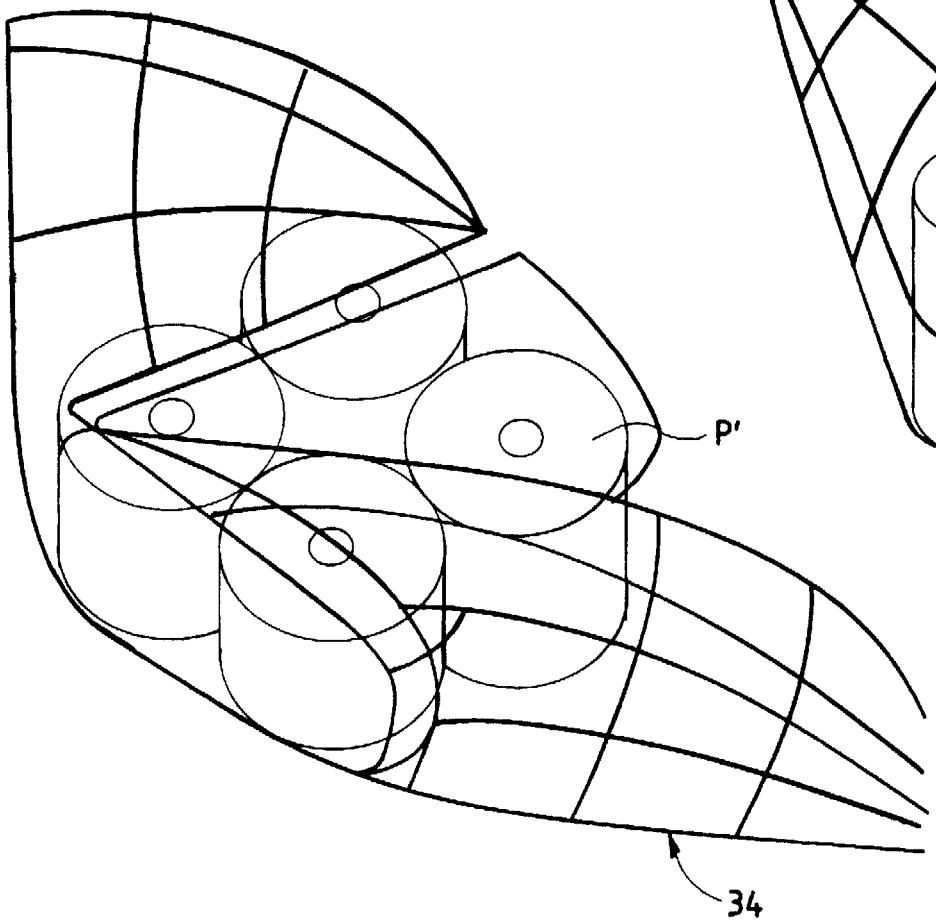
FIG. 10 is a schematic perspective view of the invention breathable girth former for products of more than one wide with cores "up"
Figure 12:
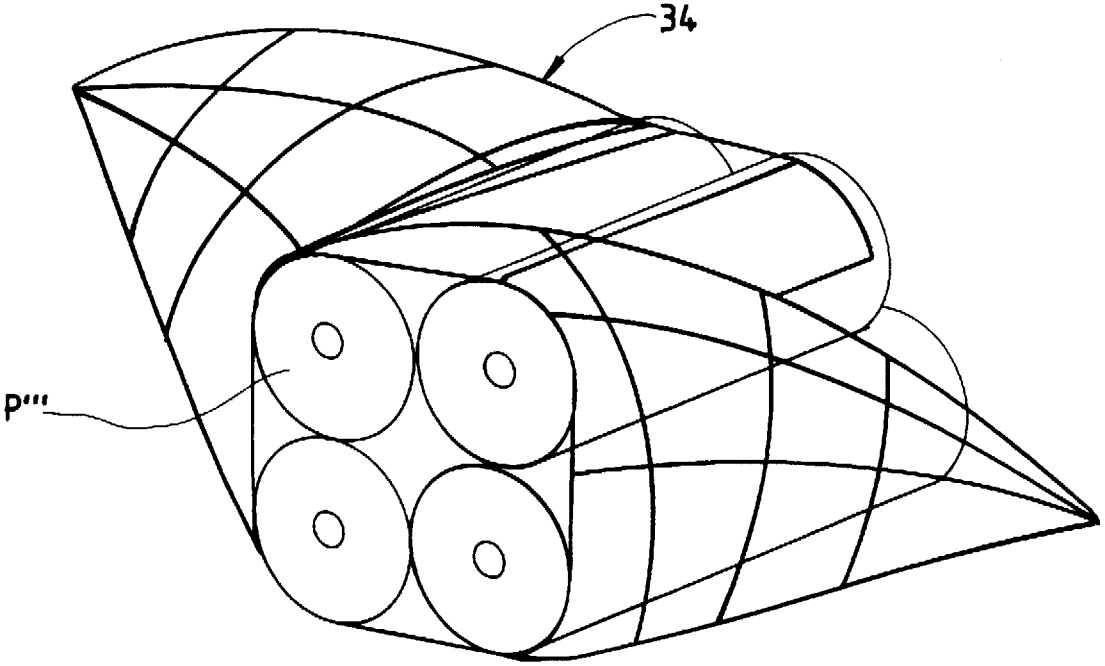
FIG. 12 is a view similar to FIGS. 10 and 11 but showing more than one product wide and two levels with the cores "down".

The invention is not limited to just enveloping single products P as illustrated in FIGS. 3–5. As illustrated in FIGS. 10–12, there are other multiple product groupings which can be packaged to advantage by the invention. In FIG. 10, for example, the cores are disposed "up"—trade practice for having the axis of the cores disposed vertically—as contrasted to the "down" showings of the cores of the products P in FIGS. 3–5. In FIG. 10, the products P' are seen to be more than one product wide. In FIG. 11, the products P" are stacked vertically, again with their cores "up". Lastly, in FIG. 12, the products P'" are shown with cores "down" but again a plurality in the entubed group.

Products have been wrapped satisfactorily ranging in size from 139 mm (approximately 5.3 inches) to 153.5 mm (approximately 6 inches) and at speeds of 135 products per minute with the arrangement being readily capable of obtaining speeds of 500–600 products per minute (ppm).

During the trials products outside diameters varying a total of 8 mm were randomly fed through the process and wrapped acceptably. In one trial, product varying a total of 12.5 mm in outside diameter successfully passed through the breathable girth former without jamming at 135 ppm.

Speed related issues are also dependent on other variables such as product quality, film gage, slip, composition and other characteristics. Materials used in the design of the breathable former could also affect speed capability.

Another factor affecting speed is product pitch. The minimum product pitch is approximately 11.25 inches (the distance between product fed into the machine).

Each side of the spring loaded funnel mechanism generates a force on the product as it passes through. The force is dependent on the spring constant, tube former set-up and product diameter and density. Each spring loaded funnel mechanism generates force on the product of approximately 2–15 pounds.

The ability to retro-fit existing machines has also been demonstrated as a result of the trials, and as pointed out above, the breathable girth former can be applied to packages containing multiple products in width and levels as well as products oriented in a cores up configuration.

The girth former automatically "breathes" to adjust for varying product outside diameters due to variation of wound roll tension, paper caliper and paper density. This eliminates the frequent jamming problem seen on earlier machines as variations would cause jams going through the girth former. The invention also permits the rewinding operations more flexibility in that product diameters do not need to be held in such close tolerance. The invention also eliminates the need for the operator to make adjustments for normal product variations seen from one product to the next.

In contrast to the prior art of co-owned U.S. Pat. No. 5,255,495, the invention makes use of a simple, reliable, mechanical coupling between the funnel and the girth former, not requiring a microprocessor to average sizes after sensing. Instead, the critical product dimension—which is determinative insofar as jamming is concerned—determines the spacing of the girth former pieces for each product (single or multiple).

While in the foregoing specification a detailed description of an embodiment of the invention has been set down, many variations in the details hereingiven may be made by those skilled in the art without departing from the spirit and scope of the invention.

We claim:

1. A method of packaging rolls of bathroom tissue product and kitchen toweling products in a packaging web formed into a tube around a tube former comprising the steps of providing a frame defining a linear path of travel for products entering an upstream end and proceeding toward a downstream end, said frame having said tube former comprising a two-piece funnel resiliently mounted adjacent said upstream end and a resiliently mounted two-piece girth former for forming a packaging tube downstream of said funnel, providing rigid connection means between said funnel pieces and said girth former pieces along with mounting means restricting movement of said pieces to a direction normal to said path, whereby lateral displacement of said funnel-providing pieces by an oversized product solely displaces said girth former pieces laterally, resiliently spacing the funnel pieces apart a distance less than the minimum dimension of each product normal to said path, and feeding a packaging web around said girth former and, introducing products sequentially into said path to solely contact with said funnel pieces and to simultaneously move said funnel pieces and said girth former pieces normally away from said path.

2. The method of claim 1 in which said steps include providing frame means with a source of film for entubing product in said girth former, and further providing said frame means with means to guide said film from said source to said girth former, and providing said guide means with a lattice work to permit ready access to said tube former connection means.

3. The method of claim 1 in which said resiliently spacing step pre-sets the funnel piece spacing normal to said path at approximately 1/16 inch (1–2 mm) less than the smallest product width.

4. The method of claim 1 in which said steps include advancing single products sequentially in spaced, end-to-end relation.

5. The method of claim 1 in which said steps include advancing product groups sequentially in spaced-apart relation.

6. The method of claim 5 in which the products have cores with the cores disposed upwardly.

7. The method of claim 5 in which the products have cores with the cores disposed down.

8. The method of claim 1 in which said steps include advancing at least 135 products per minute.

9. A breathable girth unit for a tube former in a packaging apparatus in which products comprising individual rolls or groups of rolls are conveyed continuously one after another and are packaged in film, the tube former being situated to continuously form a sheet of film passing through the tube former into a tube encapsulating and transferring succeeding product, frame means defining a longitudinally extending linear path of travel for said products, the tube former comprising;

a two-piece funnel mounted on said frame means with a funnel-providing piece on each side of said path, means for resiliently mounting said funnel-providing pieces on said frame means whereby entrance of an oversized product into and in contact with said funnel solely causes said funnel-providing pieces to move laterally outward from said linear path, two girth former pieces flanking said linear path for forming said tube, means for resiliently mounting said girth former pieces on said frame means for movement laterally toward and away from said linear path, and connecting arm means for rigidly coupling said funnel-providing pieces with said girth former pieces for cojoint movement of said girth former pieces with said funnel-providing pieces upon entrance of said oversized product into said funnel whereby lateral displacement of said funnel-providing pieces by an oversized product solely displaces said girth former pieces laterally.

10. The unit of claim 9 including adjustment means operably associated with said resilient mounting means for setting a spacing between said funnel-providing pieces less than a minimum predetermined dimension of said product whereby said funnel-providing pieces and therefore said girth former pieces move laterally outward with each product entering said funnel.

11. The unit of claim 9 in combination with a source of film mounted on said frame means, guide means on said frame means defining a path from said source to said tube former, said guide means including an open lattice work affording access to said connecting arm means.

12. The unit of claim 9 in which said tube former includes a plate slidably mounted on said frame means, said first girth former piece being secured to said plate, said second girth former piece being slidably supported on said first girth former piece.

13. The unit of claim 9 in which said frame means is equipped with a bracket for each of said girth former pieces, a rod fixed to each girth former piece, each of said brackets having a bushing receiving one of said rods to maintain the lateral movement of said girth former pieces normal to said linear path.

14. The unit of claim 9 in which each of said girth former pieces is slidably connected to said frame means in two spaced positions to maintain lateral movement of each piece normal to said linear path.

15. A breathable girth unit for a product wrapping machine comprising, a funnel provided by two flared funnel pieces which are engageable by a paper product having varying dimensions, means for resiliently mounting said funnel pieces on a frame means defining a longitudinally extending linear path of travel for said products for movement toward and away from each other, whereby entrance of an oversized product into and in contact with said funnel solely causes said funnel-providing pieces to move laterally outward from said linear path, a two-piece generally uniform cross section girth former, and connecting means for rigidly coupling the funnel and the girth former pieces for cojoint movement upon engagement of the funnel by an oversized product whereby lateral displacement of said funnel-providing pieces by an oversized product laterally displaces said girth former pieces, said girth former pieces having an entering end arranged and constructed to have an enveloping film slide thereon for forming a tube about said product.

16. The unit of claim 15 in combination with a frame defining a linear path, one piece of each of said funnel and said girth former being generally aligned on one side of said path and the other piece of each of said funnel and said girth former being generally aligned on the other side of said path.

17. The unit of claim 15 in which said entering end is equipped with a lattice work guide for said film.

18. The unit of claim 15 in combination with a frame and means for resiliently connecting said funnel pieces with said frame to maintain the funnel pieces in a non-product engaging position in which the funnel pieces are spaced apart slightly less than the minimum dimension of a product extending normal to said path.

19. The unit of claim 15 in which said connecting means includes a ball and spherical washer joint for each connection to said girth former pieces.

* * * * *